US007228668B2

(12) United States Patent
Gibney et al.

(10) Patent No.: US 7,228,668 B2
(45) **Date of Patent: *Jun. 12, 2007**

(54) PROTECTIVE COVERING AND METHOD OF MANUFACTURING

(75) Inventors: John Gibney, Yonkers, NY (US); Patrick Duggan, Yonkers, NY (US); Adrian Regan, Scarsdale, NY (US)

(73) Assignee: DRG, LLC, Yonkers, NY (US)

( * ) Notice: Subject to any disclaimer, the term of this patent is extended or adjusted under 35 U.S.C. 154(b) by 45 days.

This patent is subject to a terminal disclaimer.

(21) Appl. No.: 10/772,953

(22) Filed: Feb. 4, 2004

(65) Prior Publication Data

US 2004/0261346 A1 Dec. 30, 2004

Related U.S. Application Data

(63) Continuation-in-part of application No. 10/606,083, filed on Jun. 25, 2003, now abandoned.

(51) Int. Cl.
*E04B 2/00* (2006.01)

(52) U.S. Cl. ..... 52/506.01; 52/506.05; 52/5; 52/211; 428/40.1

(58) Field of Classification Search ..... 52/3, 52/5, 12, 506.01, 506.05, 90.1, 127.8, 741.3, 52/746.1, 408, DIG. 12, 211, 716.1, 717.01; 428/40.1, 194, 40.7
See application file for complete search history.

(56) References Cited

U.S. PATENT DOCUMENTS

| | | | | | |
|---|---|---|---|---|---|
| 2,164,322 | A * | 7/1939 | Hahn | 52/366 |
| 2,587,985 | A * | 3/1952 | Elmendorf | 52/434 |
| 3,425,889 | A | 2/1969 | Willits, Jr. | 161/43 |
| 3,611,655 | A * | 10/1971 | Loebner | 52/592.2 |
| 4,234,973 | A | 11/1980 | Vetter et al. | 4/500 |
| 4,277,527 | A | 7/1981 | Duhl | 428/109 |
| 4,768,320 | A | 9/1988 | Weller | 52/211 |
| 5,353,858 | A | 10/1994 | Hartmann | 160/264 |
| 5,365,709 | A * | 11/1994 | Lassiter | 52/408 |
| 5,401,548 | A * | 3/1995 | Stepanek | 428/40.1 |
| 5,775,045 | A | 7/1998 | Hill | 52/211 |
| 6,216,399 | B1 | 4/2001 | Belarbi | 52/169.14 |
| 6,357,187 | B1 | 3/2002 | Haldeman | 52/211 |
| 6,363,661 | B1 * | 4/2002 | Myers | 52/2.13 |
| 6,365,709 | B1 * | 4/2002 | Heibel et al. | 528/480 |
| 6,474,022 | B1 * | 11/2002 | Double et al. | 52/3 |
| 2002/0005029 | A1 | 1/2002 | Morris et al. | 53/461 |
| 2003/0070391 | A1 | 4/2003 | Tachauer et al. | 52/745.21 |
| 2003/0148071 | A1 | 8/2003 | Sneed | 428/157 |
| 2004/0261346 | A1 * | 12/2004 | Gibney et al. | 52/506.01 |

* cited by examiner

*Primary Examiner*—Richard E. Chilcot, Jr.
*Assistant Examiner*—Lindsay M. Maguire
(74) *Attorney, Agent, or Firm*—Downs Rachlin Martin PLLC

(57) ABSTRACT

A protective covering (10) for protecting surrounding items, i.e., walls, floors, and furniture, during construction, moving, or other activities. Covering (10) includes a protective backing layer (12) having a front side (14), a back side (16), opposing top and bottom edges (17) and (18), respectively, opposing left and right side edges (19) and (20), respectively, and a plurality of protective strips (22) each having a first end (24) and a second end (26). Strips (22) are securely affixed to and covering a substantial portion of front side (14). Layer (12) may include a first adhesive portion (28) along left side (19) that includes an adhesive for connecting multiple coverings (10) to one another. Back side (16) of layer (12) may also include a second adhesive portion (31), which is similar to first adhesive portion (28), for removably adhering covering (10) to underlying surfaces.

36 Claims, 6 Drawing Sheets

PROTECTIVE COVERING AND METHOD OF MANUFACTURING

RELATED APPLICATION DATA

This application is a continuation-in-part of U.S. application Ser. No. 10/606,083, filed Jun. 25, 2003, now abandoned, which is incorporated herein in its entirety.

FIELD OF THE INVENTION

The present invention relates generally to protective coverings, and more particularly to a protective covering for protecting finished work and other surfaces during construction, moving, or other activities, and a method of manufacturing the protective covering.

BACKGROUND OF THE INVENTION

The process of building out an area or constructing a building occurs in many phases. During this process, a number of different types of workers are required and it may be necessary to complete the construction in steps. As a result, frequently contractors damage door frames, stairs, and finished work in the process of completing other tasks and moving in and out heavy equipment.

Presently, contractors solve this problem by covering all surfaces, e.g., furniture, millwork, and finished work, with construction paper, taping adjacent pieces of the paper together, and then covering the paper with hardboard panels, e.g., panels sold under the trademark Masonite®. This process is very labor intensive. Also, hardboard paneling typically does not bend or fold to cover corners or intricate works.

There have been attempts to solve the specific problem of covering door frames. One device includes opposing contact edges which extend around the edge of a doorway to contact and grip opposing walls adjacent the doorway. While the device does protect doorways, it is too specific and not easily adaptable. For instance, different sizes have to be purchased for different size door frames.

SUMMARY OF THE INVENTION

One aspect of the present invention is a protective covering for use during construction, including a protective backing layer having front and back surfaces defined by opposing top and bottom edges and opposing left and right side edges, the protective backing layer being formed from a first material, a plurality of protective strips attached to the protective backing layer, the plurality of protective strips being arranged so as to provide uncovered portions of the front surface between each of the strips, the protective strips being formed from a second material, and one or more flap portions proximate at least one of the top, bottom, left, and right edges by a portion of the front surface that is not covered by the plurality of protective strips, the flap portion including an adhesive and a removable topsheet.

Another aspect of the present invention is a protective covering for use during construction including a protective backing layer formed from a first material, a plurality of protective portions attached to and covering portions of the protective backing layer and at least one flap portion. The plurality of protective portions being arranged so that portions of the protective backing layer are exposed between each of the protective portions, the protective portions being formed from a second material tat is different than the first material. The at least one flap portion not being covered by the plurality of protective portions.

A further aspect of the present invention is a protective covering for use during construction including a protective backing layer, a plurality of protective strips attached to and covering portions of the protective backing layer, and one or more flap portions that are not covered by the plurality of protective strips, the one or more flap portions including an adhesive.

Yet another aspect of the present invention is a method of manufacturing a protective covering for use during construction including the following steps: providing a protective backing layer formed from a first material; and attaching a plurality of protective portions to the protective backing layer so as to define a flap portion that is not covered by the plurality of protective portions, the plurality of protective portions being formed from a second material.

In yet another embodiment of the present invention is a protective covering for use during construction including a protective backing layer, a plurality of protective strips attached to and covering portions of the protective backing layer and at least one flap portion that is not covered by said plurality of protective strips.

Other features, utilities and advantages of various embodiments of the invention will be apparent from the following more particular description of embodiments of the invention as illustrated in the accompanying drawings.

BRIEF DESCRIPTION OF THE DRAWINGS

For the purpose of illustrating the invention, the drawings show a form of the invention that is presently preferred. However, it should be understood that the present invention is not limited to the precise arrangements and instrumentalities shown in the drawings, wherein:

Referring to FIG. 8, one embodiment of a protective covering 100 is illustrated. Examples of items tat may be protected by protective covering 100, includes but are not limited to walls, floors, furniture, etc. Protective covering 100 includes protective backing layer 102, a plurality of protective strips 120 attached to and covering portions of the protective backing layer, and at least one flap portion 130. Flap portion 130 is not covered by plurality of protective strips 120.

Figure 1:
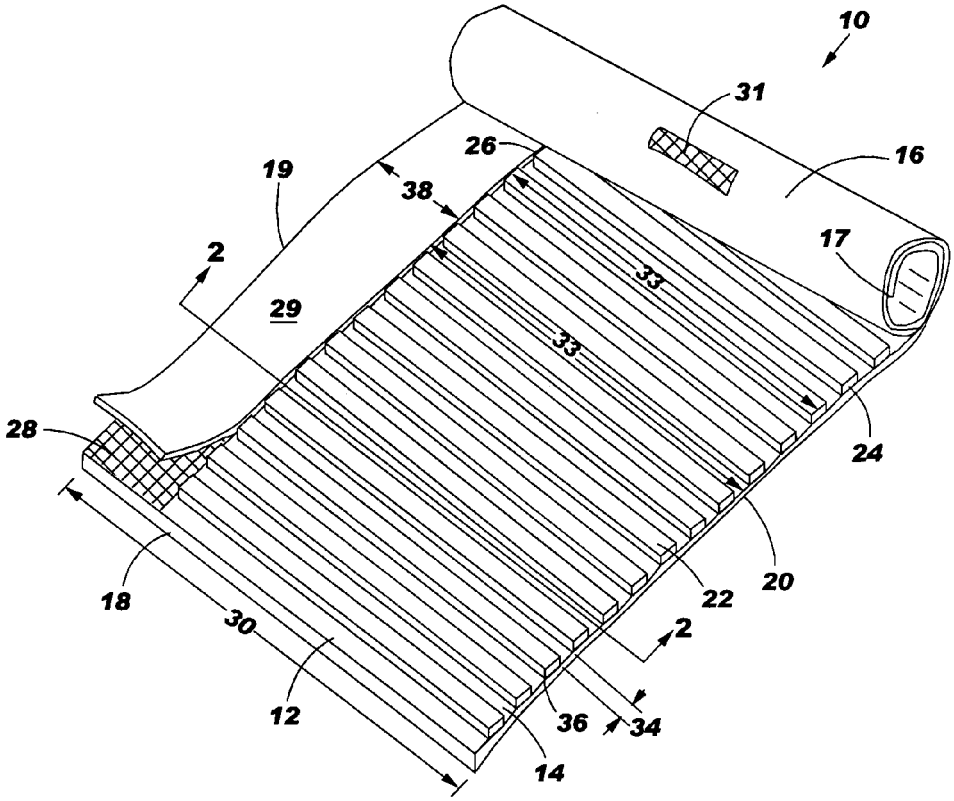
FIG. 1 is a front isometric view of one embodiment of the present invention.

Protective backing layer 102 includes a front side 104, opposing top and bottom edges 108 arid 110, respectively, opposing left and right side edges 112 and 114, respectively. Plurality of protective strips 120 each have a first end 122 and a second end 124. In one example, plurality of protective strips 120 do not run along the entire width of protective backing layer 102 from left side edge 112 to right side edge 114. Strips 120 are securely affixed to front side 104. Covering 100 includes a flap portion 130, which is an area on front side 104 without the plurality of strips 120. Flap portion 130 is defined on backing layer 102 between an edge, such as left side edge 112, and to the ends of strips 120, such as first ends 122, with a flap portion width 132, running along from top edge 108 to bottom edge 110. Flap portion 130 may optionally receive an adhesive for receiving another covering in a parallel fashion to accommodate a wider or bigger protection area. This is discussed in greater detail below.

Figure 9:
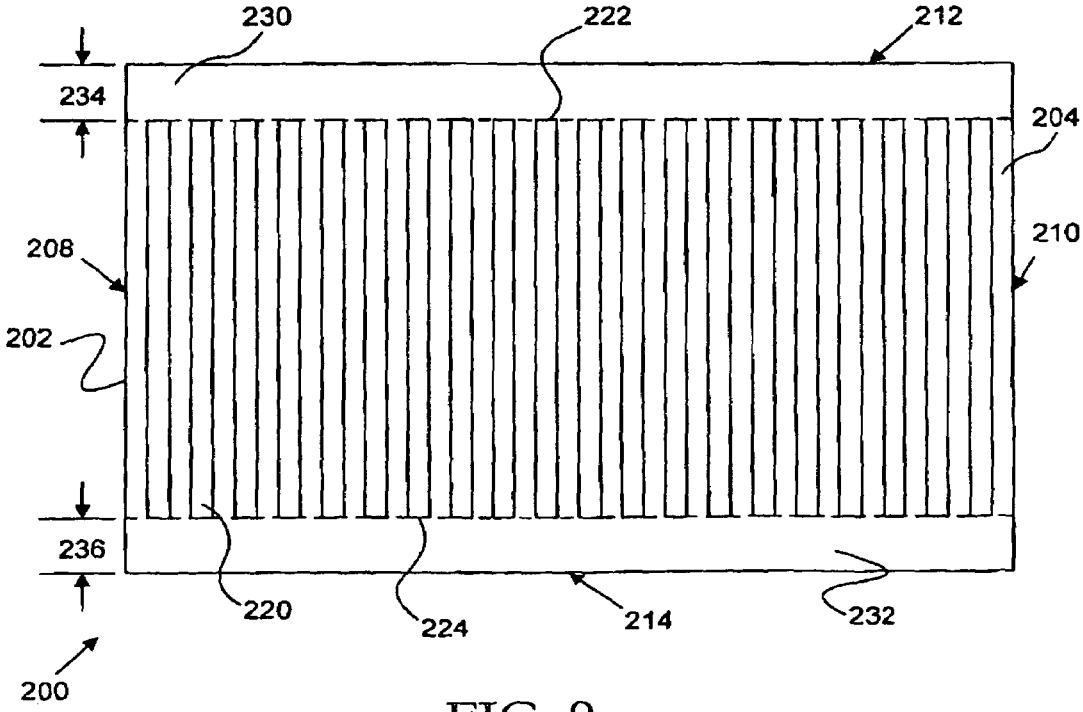
FIG. 9 is a too view of another embodiment of the present invention.

Referring to FIG. 9, another embodiment of the present invention is a protective covering 200 is illustrated. Protective covering 200 includes a protective backing layer 202, a plurality of protective strips 220 attached to and covering portions of the protective backing layer, a first flap portion 230 and a second flap portion 232. Flap portions 230 and 232 are not covered by plurality of protective strips.

Protective backing layer 202 includes a front side 204, opposing top and bottom edges 208 and 210, respectively, and opposing left and right side edges 212 and 214, respectively. Plurality of protective strips 220 each have a first end 222 and a second end 224. Strips 220 are securely affixed to and covering front side 204. First flap portion 230 is along backing layer 202 between left side edge 212 and the first ends 222 of strips 220 running from top edge 208 to bottom edge 210, with a first flap portion width 234. Likewise, flap portion 232 is along backing layer 202 between right side edge 214 and the second ends 224 of strips 220 running from top edge 208 to bottom edge 210, with a second flap portion width 236. Flap portions 230 and 232 may optionally receive an adhesive for receiving other protective coverings on either edge of covering 200.

DETAILED DESCRIPTION OF THE DRAWINGS

Figure 2:
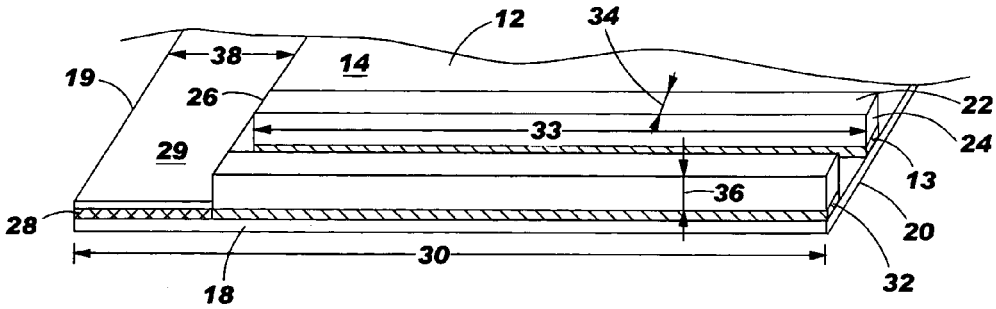
FIG. 2 is a section view taken along line 2-2 of FIG. 1.

Referring now FIGS. 1 and 2, one embodiment of the present invention is a protective covering 10 for protecting surrounding items, i.e., walls, floors, furniture, etc., during construction activities or when moving such items. Covering 10 includes a protective backing layer 12 having a front side 14, a back side 16, opposing top and bottom edges 17 and 18, respectively, opposing left and right side edges 19 and 20, respectively, and a plurality of protective strips 22 each having a first end 24 and a second end 26. Strips 22 are securely affixed to and covering front side 14.

Although layer 12 is depicted as a continuous sheet of material in FIG. 1, alternatively, it may take the form of a web, a mesh, a series of strips, or a combination of the above. Layer 12 is formed from a first material, which may include one or a combination of paper or other cellulose materials, plastic, cloth, or any other pliable material. The paper may, for example, be kraft paper, non-reinforced paper, reinforced paper, red rosin paper, or reinforced paper. Optionally, layer 12 may include a first adhesive portion 28 (also referred to as flap portion 28) along left side edge 19 that includes an adhesive for connecting multiple coverings 10 to one another. Any adhesive known within the art including a peel away tape having a removable strip covering or a first topsheet 29 may be utilized. In one embodiment, layer 12 has an overall width 30 of approximately six inches to eight feet, which is generally, but not always, selected to be at least slightly longer than the length of strips 22. Back side 16 of layer 12 may also include a second adhesive portion 31, which is similar to first adhesive portion 28, for removably adhering covering 10 to underlying surfaces. Adhesive portions 31 may be segmented or continuous strips running the length or width of layer 12 or may be discrete portions positioned in any suitable location. A second topsheet (not shown) is often provided to cover adhesive portion 31.

Typically, strips 22 are arranged in a substantially parallel fashion with first end 24 abutting or nearly abutting right side edge 20 to allow covering 10 to be rolled-up, e.g., like a carpet. Strips 22 are generally arranged so portions of front side 14 are exposed between each of the strips. The portion of front side 14 that is exposed and the particular spacing between each of strips 22 are influenced by the application. For example, in an instance where wheeled objects are transported over strips 22, the wheel diameter and width will affect the spacing between the strips. Referring now to FIG. 2, in one embodiment, strips 22 are affixed to layer 12 using an adhesive 32. In other embodiments strips 22 may be joined with layer 12 using two-sided adhesive tape, screws, rivets, tacks or other similar fasteners. Strips 22 are fabricated from a second material that typically differs from the first material used for layer 12. The material used for strips 22 is typically relatively dense, may be cut fairly easily with hand or power saws, and is relatively resistant to splitting or breaking apart when subjected to forces of the type routinely encountered in construction. Suitable materials for the second material may include one or more of the following: Masonite® panels, plastic, plywood, polymers, Corex® panels, homasote, metal, cardboard, and sound board. Typically, strips 22 have a length 33 of approximately six inches to eight feet, a width 34 of approximately ½ inch to 24 inches, and a thickness or height 36 of approximately 1/16 inch to one inch. Typically, strips 22 are spaced about one to six inches from left side edge 19. This spacing, i.e., width 38, provides space for adhesive portion 28 and topsheet 29. In FIG. 1, strips 22 are evenly spaced from one another, although even spacing is not required. Strips 22 are typically spaced at a distance between ⅛ to four inches from one another. In other embodiments, strips 22 may not have any spacing between one another.

Figure 3:
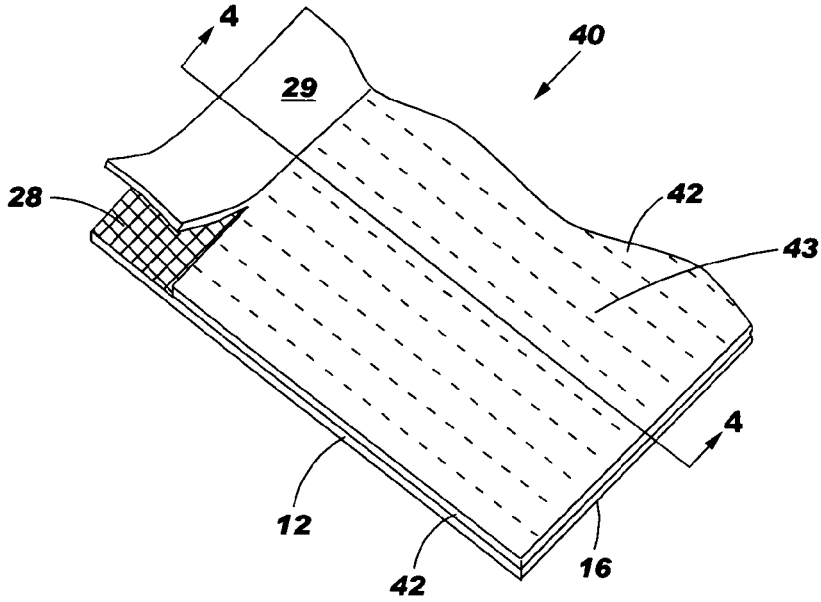
FIG. 3 is a front isometric view of one embodiment of the present invention.
Figure 4:
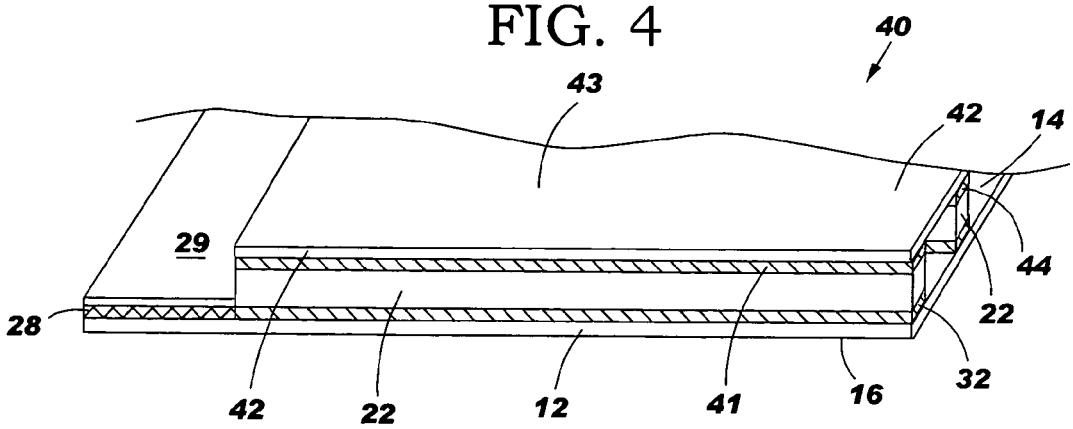
FIG. 4 is a section view taken along line 4-4 of FIG. 3.

Referring now to FIGS. 3 and 4, where elements similar to those in the embodiment illustrated in FIG. 1 are numbered similarly, an alternative protective covering 40 of the present invention is illustrated. Covering 40 is virtually identical to covering 10 with the exception that covering 40 further includes a top layer or second protective backing layer 42 that is adhered to the surface of strips 22 opposite the surface joined with layer 12 using an adhesive 44, which is similar to or the same as adhesive 32 described above. Layer 42 provides additional protection to the underlying surface and allows covering 40 to be applied with indifference to which side, i.e., bottom side 16 of layer 12 or a top side 43 of layer 42, is placed in contact with the underlying surface. Optionally, covering 40 may include a second portion having adhesive portion 28 and topsheet 29, which is positioned on the opposite end and opposite side as adhesive portion 28 and topsheet 29 in FIGS. 3 and 4 (not shown).

Figure 5:
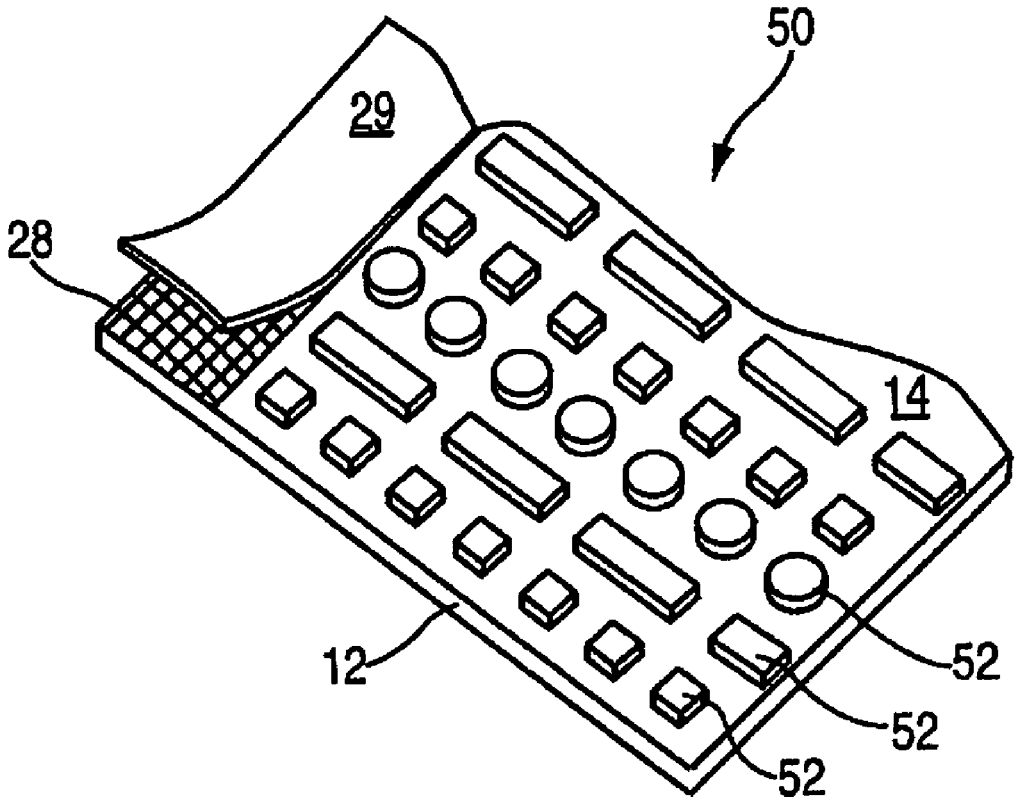
FIG. 5 is a front isometric view of one embodiment of the present invention.

FIG. 5 illustrates alternative covering 50 of the present invention. Covering 50 is virtually identical to covering 10 with the exception that instead of strips 22, a plurality of protective portions 52 are adhered to front side 14 of layer 12. Protective portions 52 are typically joined with layer 12 in the same manner as strips 22. Protective portions 52 are typically arranged and positioned in a uniform pattern to ensure that a significant portion of the surface area of front side 14 is covered by the portions. Portions 52 may be formed in any shape that allows covering 50 to be rolled-up or folded, e.g., circular, square, rectangular, or combination of the above. In one embodiment, portions 52 are ¾ inch by ¾ inch squares having a similar thickness as described above with respect to strips 22. As with strips 22, the spacing of portions 52 is determined according to the specific application.

In use, protective coverings 10, 40, or 50 are typically transported in rolls to a construction site or a moving site. However, in some instances, protective coverings 10, 40, and 50 may be either folded or provided in smaller pieces and transported in boxes. The coverings are unrolled and fit to surfaces and objects in the area where the construction or moving activities will occur. The coverings may be cut into various sizes to custom-fit certain areas and certain objects. Multiple coverings may be joined together using first adhesive portion 28. The coverings are used in place of sheets formed from Masonite® panels, plastic, plywood, polymers, Corex® panels, homasote, metal, cardboard, sound board, or similar, to protect the surfaces or objects from collateral damage that may result from the construction or moving activities.

Figure 6:
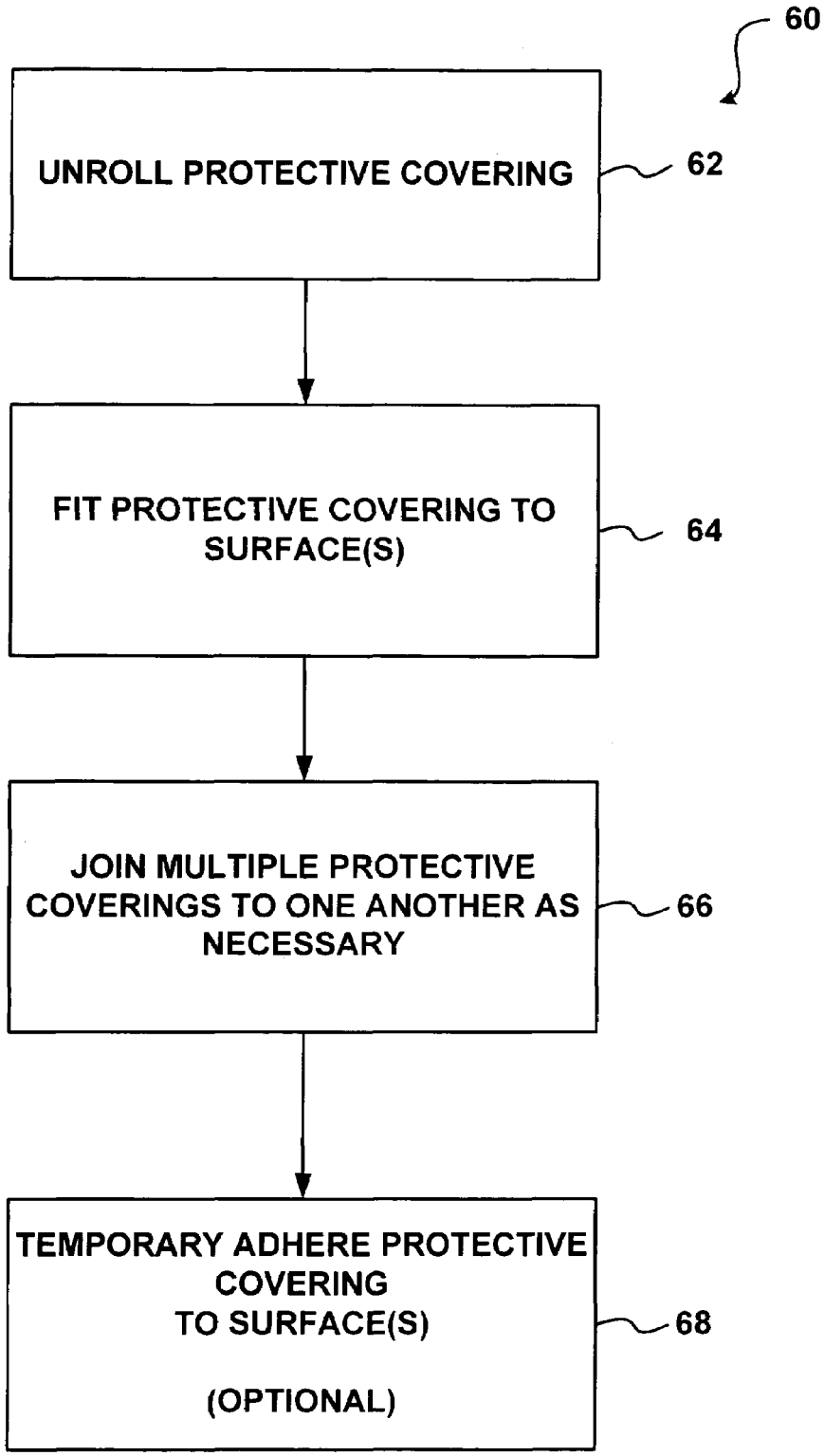
FIG. 6 is a flowchart of the steps of a method of protecting surfaces during construction or moving activities according to one embodiment of the present invention.

FIG. 6 illustrates the steps of a method 60 of protecting surfaces from damage caused by construction, moving, or other activities. First, at step 62, a piece of protective covering 10 is unrolled or unfolded. Of course, method 60 may also be practiced using either protective covering 40 or protective covering 50. Then, at step 64, protective covering 10 is fitted to the surfaces that are to be protected from damage. This fitting may involve removing pieces of covering 10, which can easily be performed using hand or power saws, snips, or other tools. In some cases, e.g., to cover a light fixture, large pieces of protective covering 10 are cut into one or more smaller pieces during step 64. In other instances, e.g., to cover flooring, large pieces of protective covering 10 are used in their original form. As illustrated at step 66, in many instances, multiple pieces of protective covering 10 are joined to one another. Typically, during step 66 topsheet 29 is removed from a first piece of protective covering 10 thereby exposing first adhesive portion 28. The edge, i.e., right side edge 20, of a second piece of protective covering 10 is then positioned on top of first adhesive portion 28 thereby joining the first and second pieces of protective portion 10 to one another. Optionally, at step 68, all or the pieces of protective covering 10 are temporarily adhered to the surfaces that are to be protected from damage. Typically, the pieces of protective covering 10 are temporarily adhered to the surfaces using adhesive portions 31, tape or some other non-destructive, temporary, joining material.

Figure 7:
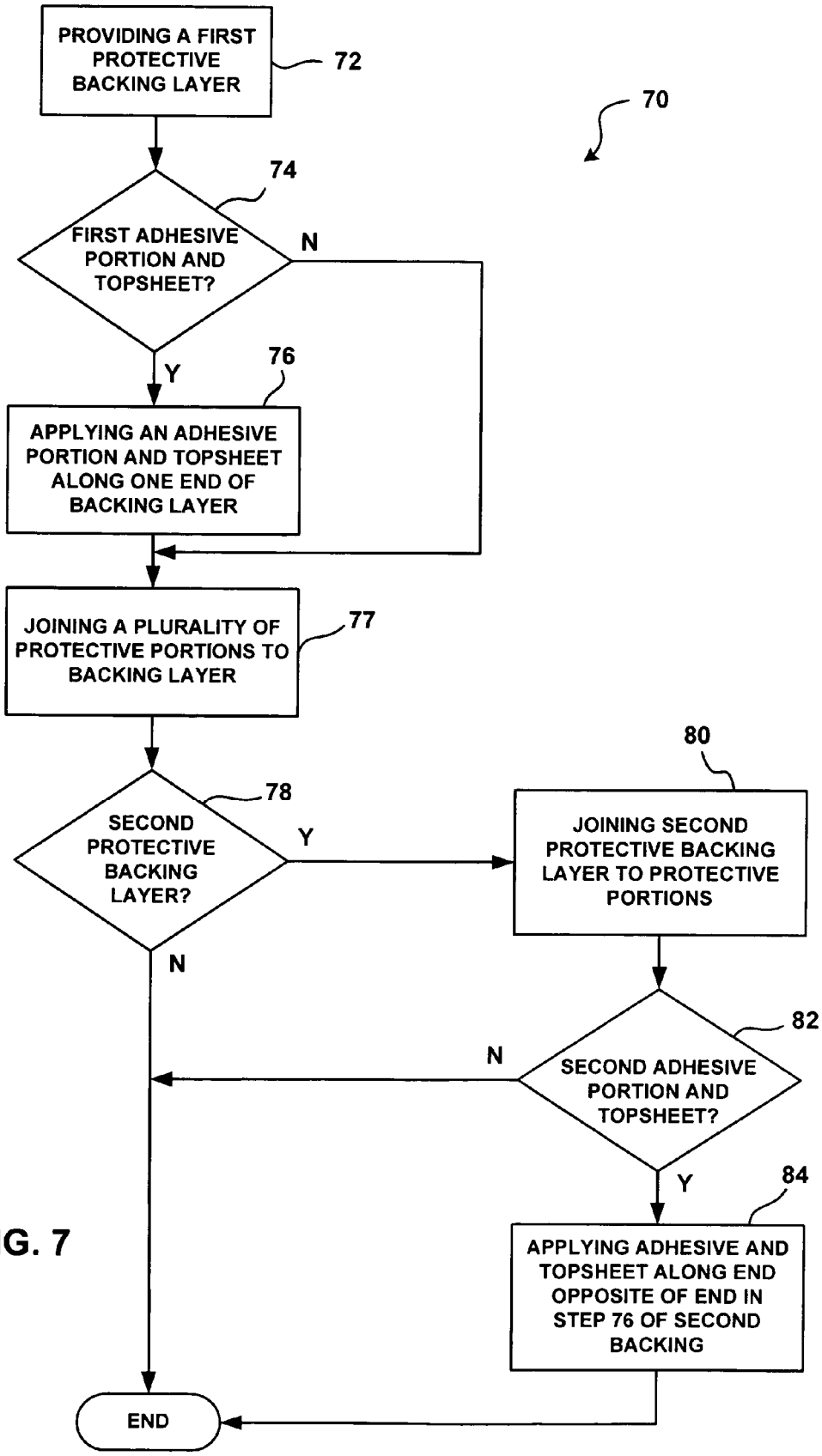
FIG. 7 is a flowchart of the steps of a method of manufacturing one embodiment of the present invention.
Figure 8:
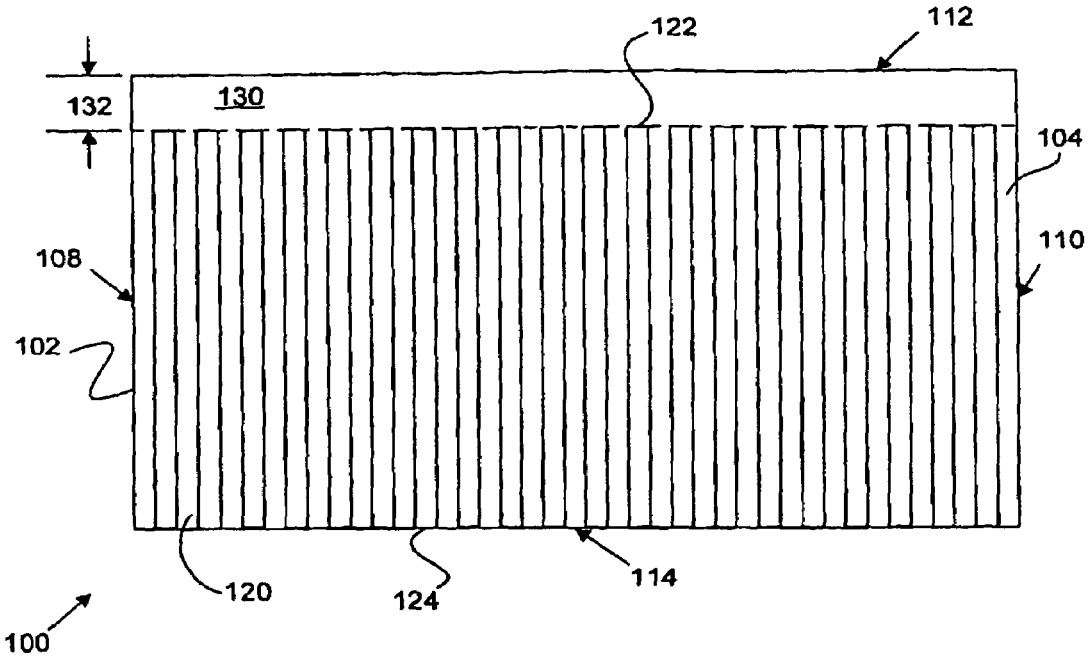
FIG. 8 is a top view of one embodiment of the present invention.

FIG. 7 illustrates the steps for a method 70 of manufacturing a protective covering according to the present invention. First, at step 72, a first protective backing layer 12 is provided. Next, at step 74, it is determined whether first adhesive portion 28 and topsheet 29 should be applied to first protective backing layer 12. If yes, at step 76, adhesive portion 28 and topsheet 29 are applied to a section of surface 14 of first protective backing layer 12. If no, at step 74, or after step 76, a plurality of protective portions, e.g., strips 22, protective portions 52, or portions of other configurations, are joined to a surface 14 of first protective backing layer 12 at step 77. Next, at step 78, it is determined whether a second protective backing layer 42 should be joined with protective portions 22, 52. If no, the process ends. If yes, at step 80, second protective backing layer 42 is joined to protective portions 22, 52 thereby causing the protective portions to be positioned between the first and second protective backing layers 12, 42. Then, at step 82, it is determined whether a second adhesive portion 31 and topsheet should be applied to back side 16 of first protective backing layer 12. If no, the process ends. If yes, at step 84, second adhesive portion 31 and topsheet are applied to back side 16 of first protective backing layer 12 adjacent the side edge opposite first adhesive portion 28. After step 84, the process ends.

Although the invention has been described and illustrated with respect to exemplary embodiments thereof, it should be understood by those skilled in the art that the foregoing and various other changes, omissions and additions may be made therein and thereto, without parting from the spirit and scope of the present invention.

What is claimed is:

1. A protective covering for use during construction, comprising:

a protective backing layer having front and back surfaces defined by opposing top and bottom edges and opposing left and right side edges, said protective backing layer being formed from a first material;

a plurality of protective strips attached to said protective backing layer, said plurality of protective strips being arranged so as to provide uncovered portions of said front surface between each of the strips, said protective strips being formed from a second material; and one or more flap portions proximate at least one of said top, bottom, left, and right edges by a portion of said front surface that is not covered by said plurality of protective strips, said flap portion including an adhesive and a removable top sheet.

2. A protective covering according to claim 1, further comprising means for binding said plurality of protective strips to said front side.

3. A protective covering according to claim 1, wherein said plurality of protective strips have a thickness of substantially 1/16 to 1 inch.

4. A protective covering according to claim 1, wherein said plurality of protective strips have a width of substantially ½ to 24 inches.

5. A protective covering according to claim 1, wherein said plurality of protective strips have a length of substantially 6 inches to 8 feet.

6. A protective covering according to claim 1, wherein said plurality of protective strips are positioned so as to be substantially parallel to one another.

7. A protective covering according to claim 1, further comprising a second protective backing layer joined with said plurality of protective strips opposite said protective backing layer.

8. A protective covering for use during construction, comprising:

a protective backing layer formed from a first material;

a plurality of protective portions attached to and covering portions of said protective backing layer, said plurality of protective portions being arranged so that portions of said protective backing layer are exposed between each of said protective portions, said protective portions being formed from a second material that is different than said first material; and at least one flap portion, said at least one flap portion not being covered by said plurality of protective portions.

9. A protective covering according to claim 8, wherein said at least one flap portion includes an adhesive.

10. A protective covering according to claim 9, said flap portion including a removable topsheet covering said adhesive.

11. A protective covering according to claim 8, further comprising an adhesive for binding said plurality of protective portions to said protective backing layer.

12. A protective covering according to claim 8, wherein said plurality of protective portions have a thickness of substantially 1/16 to 1 inch.

13. A protective covering according to claim 8, wherein said protective portions have a circular, square, or rectangular shape.

14. A protective covering according to claim 8, further comprising a second protective backing layer in contact with said plurality of protective portions opposite said protective backing layer.

15. A protective covering for use during construction, comprising:

a protective backing layer;

a plurality of protective strips attached to and covering portions of said protective backing layer; and one or more flap portions that are not covered by said plurality of protective strips, said one or more flap portions including an adhesive.

16. A protective covering according to claim 15, wherein said plurality of protective strips are arranged so that portions of said protective backing layer are exposed between each of said strips.

17. A protective covering according to claim 15, further comprising means for binding said plurality of protective strips to said front side.

18. A protective covering according to claim 15, wherein said plurality of protective strips have a thickness of substantially 1/16 to 1 inch.

19. A protective covering according to claim 15, wherein said plurality of protective strips have a width of substantially ½ to 24 inches.

20. A protective covering according to claim 15, wherein said plurality of protective strips have a length of substantially 6 inches to 8 feet.

21. A protective covering according to claim 15, wherein said plurality of protective strips are positioned so as to be substantially parallel to one another.

22. A protective covering according to claim 15, further comprising a second protective backing layer joined with said plurality of protective strips opposite said protective backing layer.

23. A method of manufacturing a protective covering for use during construction, comprising the steps of:

providing a protective backing layer formed from a first material; and attaching a plurality of protective portions to said protective backing layer so as to define a flap portion that is not covered by said plurality of protective portions, said plurality of protective portions being formed from a second material.

24. A method according to claim 23, further comprising the step of applying an adhesive to said flap portion.

25. A method according to claim 23, further comprising the step of binding said plurality of protective portions to said front surface using an adhesive.

26. A method according to claim 23, wherein said plurality of protective portions in said attaching step have one of a circle, square, and rectangle shape.

27. A method according to claim 23, further comprising the step of positioning said plurality of protective portions in said aft aching step so as to expose portions of said front surface between each of the protective portions.

28. A method according to claim 23, further comprising the step of placing a protective top layer over said plurality of protective portions so that said plurality of protective portions are positioned between said protective backing layer and said protective top layer.

29. A protective covering for use during construction, comprising:

a protective backing layer;

a plurality of protective strips attached to and covering portions of said protective backing layer; and at least one flap portion that is not covered by said plurality of protective strips.

30. A protective covering according to claim 29, wherein:

said protective backing layer having front and back surfaces defined by opposing top and bottom edges and opposing left and right side edges, said protective backing layer being formed from a first material;

said plurality of protective strips being arranged so as to provide uncovered portions of said front surface between each of the strips, said protective strips being formed from a second material; and said at least one flap portion proximate at least one of said top, bottom, left, and right edges.

31. A protective covering according to claim 29, wherein said at least one flap portion is at a first edge of said protective backing layer and another said at least one flap portion at a second edge of said protective backing layer, said second edge being opposite of said first edge.

32. A protective covering according to claim 29, wherein said plurality of protective strips are arranged so that portions of said protective backing layer are exposed between each of said strips.

33. A protective covering according to claim 29, further comprising a means for binding said plurality of protective strips to said protective backing layer.

34. A protective covering according to claim 29, wherein said plurality of protective strips are positioned so as to be substantially parallel to one another.

35. A protective covering according to claim 29, further comprising a second protective backing layer joined with said plurality of protective strips opposite said protective backing layer.

36. A protective covering according to claim 29, wherein said at least one flap portion includes an adhesive.

* * * * *

UNITED STATES PATENT AND TRADEMARK OFFICE

CERTIFICATE OF CORRECTION

PATENT NO. : 7,228,668 B2
APPLICATION NO. : 10/772953
DATED : June 12, 2007
INVENTOR(S) : Gibney et al.

It is certified that error appears in the above-identified patent and that said Letters Patent is hereby corrected as shown below:

In claim 27, column 8, line 6, delete “aft aching” and insert -- attaching -- therefor.

Signed and Sealed this

Sixth Day of November, 2007

JON W. DUDAS
*Director of the United States Patent and Trademark Office*